United States Patent [19]

Ball

[11] 4,202,669

[45] May 13, 1980

[54] FIRE-LIGHTERS

[76] Inventor: Andrew C. Ball, Tunstead Farm, Tunstead La., Greenfield, Saddleworth near Oldham, Lancashire, England

[21] Appl. No.: 680,999

[22] Filed: Apr. 28, 1976

[30] Foreign Application Priority Data

| | | | |
|---|---|---|---|
| Apr. 30, 1975 | [GB] | United Kingdom | 18095/75 |
| Jul. 11, 1975 | [GB] | United Kingdom | 29313/75 |
| Jan. 8, 1976 | [GB] | United Kingdom | 596/76 |

[51] Int. Cl.[2] ..... C10L 11/00

[52] U.S. Cl. ..... 44/40; 44/38; 44/41

[58] Field of Search ..... 44/34, 38, 40, 41

[56] References Cited

U.S. PATENT DOCUMENTS

| | | | |
|---|---|---|---|
| 3,210,908 | 10/1965 | Samberg | 53/182 |
| 3,231,346 | 1/1966 | Wilder | 44/41 X |
| 3,351,443 | 11/1967 | Gramm et al. | 44/40 |

FOREIGN PATENT DOCUMENTS

| | | | |
|---|---|---|---|
| 1476746 | 3/1967 | France . | |
| 1525126 | 4/1968 | France . | |
| 589594 | 6/1947 | United Kingdom . | |
| 949636 | 2/1964 | United Kingdom | 44/40 |
| 990332 | 4/1965 | United Kingdom . | |

*Primary Examiner*—Carl F. Dees

*Attorney, Agent, or Firm*—John C. Smith, Jr.

[57] ABSTRACT

According to the invention a fire-lighter has an air-tight combustible skin, so that the fire-lighter may be handled and placed in position in a fire without dirtying the hands or releasing the odor of the fire-lighter.

5 Claims, 5 Drawing Figures

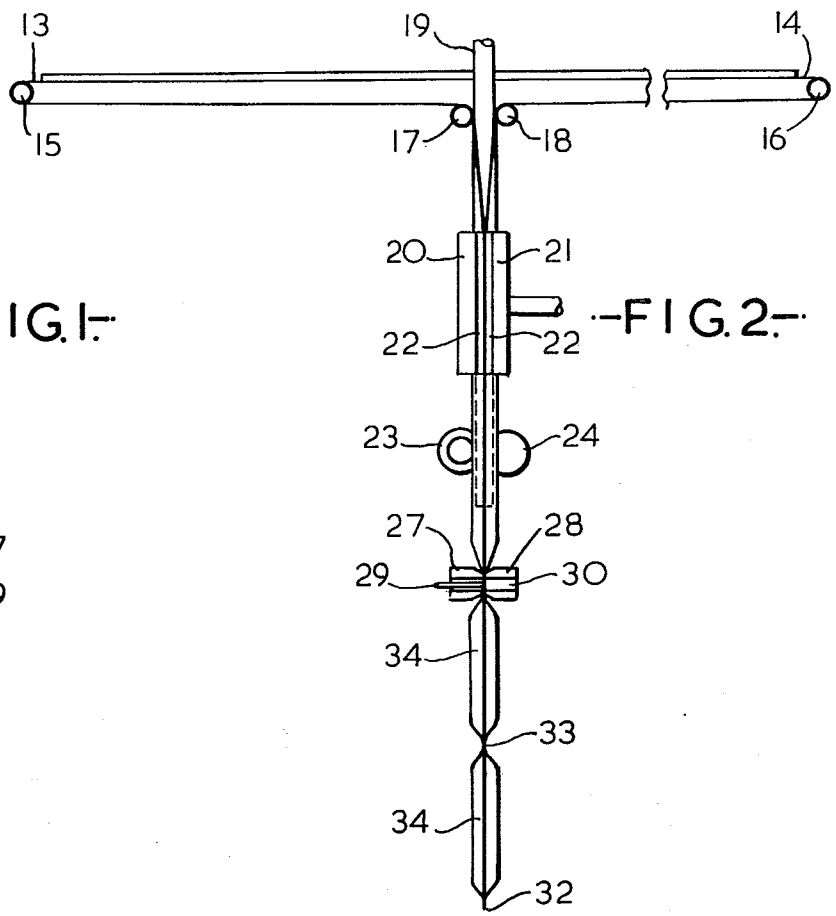
-FIG. 2-
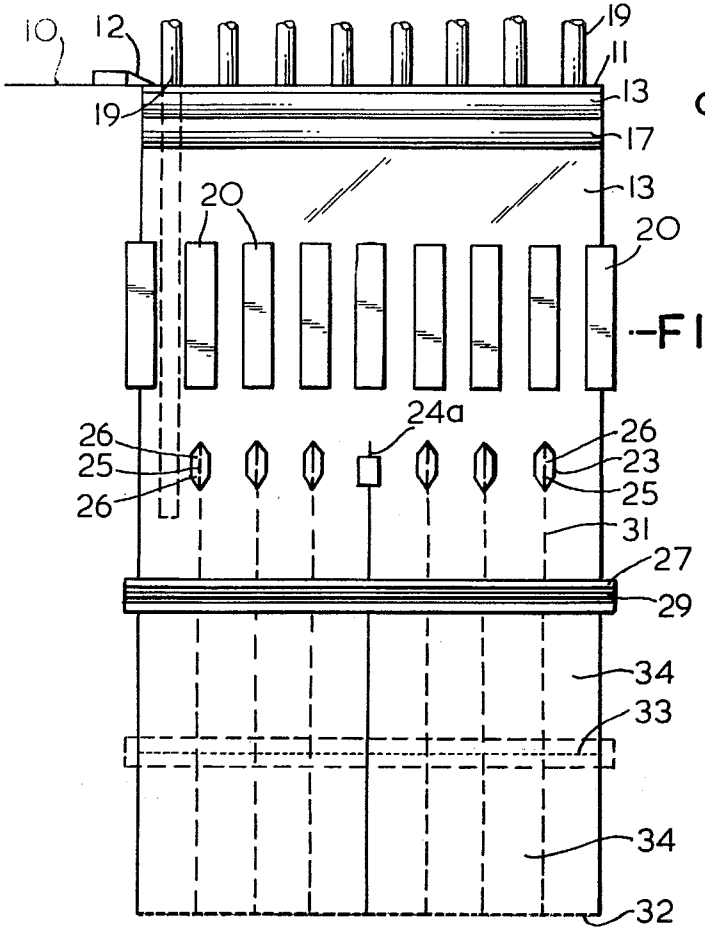
-FIG. 1-

-FIG. 3-
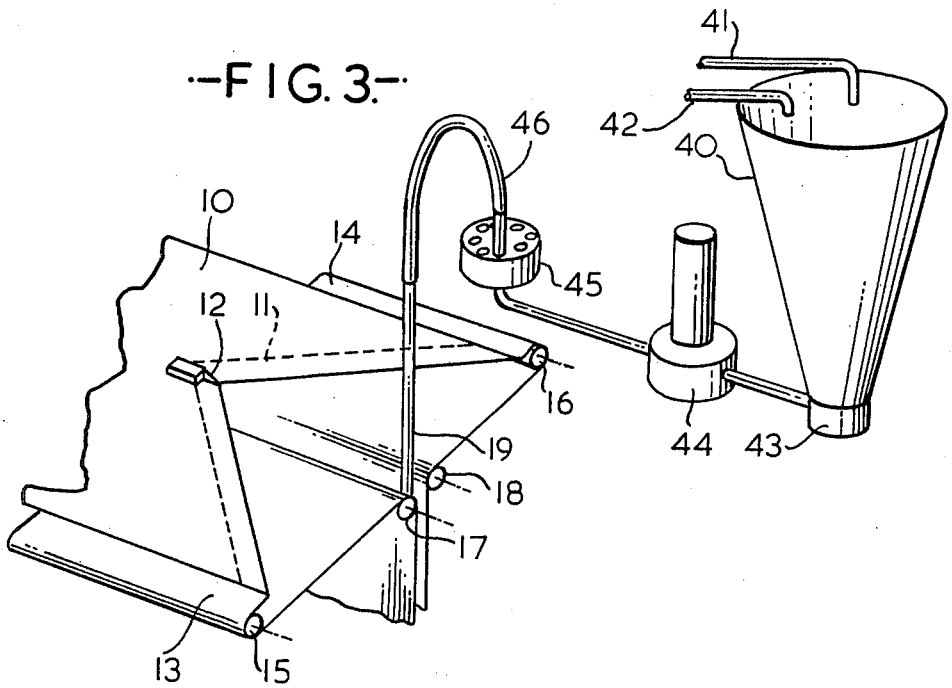
-FIG. 4-
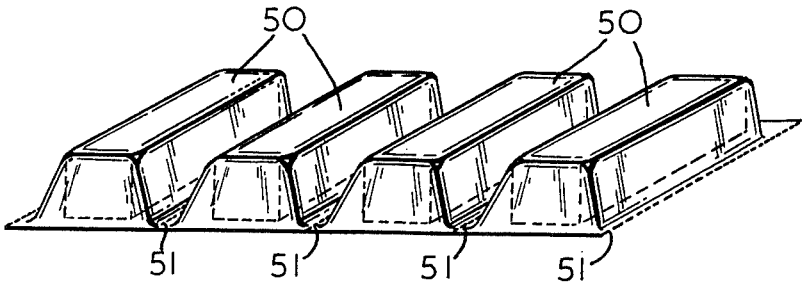
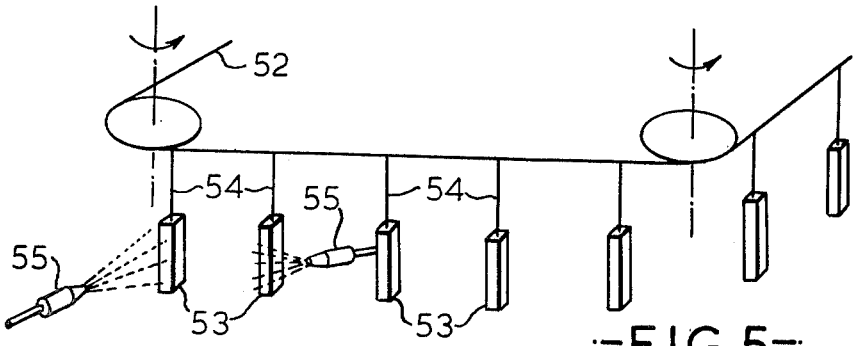
-FIG. 5-

FIRE-LIGHTERS

The invention relates to fire-lighters.

Many varieties of fire-lighter are available, and the majority comprise some form of paraffin impregnated carrier. They have an unpleasant smell and even if they are handled only briefly, the odour is transferred to the hands and it is some time before it wears off, even if the hands are washed several times. Although such fire-lighters have been available for many years, and the above mentioned problem has always existed, a solution to the problem has not so far been provided.

I have now discovered that it is possible to provide an effective but odour-free fire-lighter and accordingly the invention provides a fire-lighter having an air-tight combustible skin, so that the fire-lighter may be handled and placed in position in a fire without dirtying the hands or releasing the odour of the fire-lighter.

Preferably the fire-lighter is arranged in combination with one or more similar fire-lighters and with the skins of the fire-lighters connected together to form a package.

It is preferred that the skins are separated by lines of weakness (e.g. lines of perforations or slits) to make the individual fire-lighters readily detachable from one another.

The or each skin may be made of plastics material, for example polythene, polyethylene, or a derivative thereof.

The invention includes a method of manufacturing a fire-lighter, comprising forming a fire-lighter having an air-tight combustible skin.

The method may comprise the steps of forming a combustible envelope, inserting a fluid fire-lighter mixture into the envelope, sealing the envelope, and allowing the mixture to set.

The setting of a fluid fire-lighter mixture generally results from the interaction of at least two ingredients, for example urea-formaldehyde resin and an acid catalyst. Fire-lighters are conventionally prepared by mixing all the ingredients together, the quantities being chosen to give a setting time of the order of four minutes. The mixture is then poured into moulds and allowed to set.

Fire-lighters according to the invention may be prepared by pouring a conventional mixture into the envelope, but in order to facilitate the preparation of a large number of fire-lighters by a continuous process, it is preferred to use a very much slower setting time, of the order of twenty-four hours.

Preferably a plurality of envelopes are formed simultaneously by sealing together two layers of combustible plastics material and the fluid fire-lighter mixture is then injected into the envelopes simultaneously through a plurality of nozzles.

Two continuous layers may be used, the layers being positioned one on each side of a plurality of parallel spaced apart injection nozzles, a plurality of heaters are used to seal the layers together to form a plurality of tubes each containing a nozzle, a heater extending transversely of the nozzles, below the nozzles, is used to make a transverse seal thereby forming a first set of envelopes, the fire-lighter mixture is then injected into each envelope of the set, the filled envelopes are drawn away from the nozzles, and a further transverse seal is made to seal the first set of envelopes and form the first seal of a second set of envelopes. The slow setting time prevents the nozzles from becoming clogged. As an alternative however, a rapid setting time may be used, of the order of twenty to thirty seconds, the setting ingredients being fed into each envelope through separate nozzles, so that setting does not commence until the ingredients are mixed in the envelope, and then proceeds rapidly.

Cutting wheels may be used to form lines of perforations between adjacent tubes.

The transversely extending heater may incorporate a knife, the knife being adjustable so that it can cut completely through the sealed layers to separate a set of sealed envelopes, or can partially cut through the sealed layers to provide a line of weakness separating a set of envelopes from the next set of envelopes.

According to an alternative method, a fire-lighter may be shrink-wrapped in a plastics film, the film forming the air tight combustible skin.

According to another alternative, the air tight combustible skin may be formed by applying a fluid to a fire-lighter, and allowing or causing the fluid to set to provide the skin.

The fluid may be applied by spraying, by painting, by dipping the fire-lighter into the fluid, or by other means.

The fluid may for example comprise a molten plastics material, which solidifies on cooling, or a plastics material dissolved in a solvent, removal of the solvent (e.g. by evaporation) causing the plastics material to solidify. Alternatively the fluid may comprise a mixture of a fluid plastics material and a hardener.

By way of example, specific embodiments of the invention will now be described, with reference to the accompanying drawings, in which:

FIG. 1 illustrates one method of manufacturing fire-lighters according to the invention, looking at the front of apparatus used to carry out the method;

FIG. 2 is a side view of the apparatus shown in FIG. 1;

FIG. 3 is a perspective view of the upper part of the apparatus shown in FIGS. 1 and 2;

FIG. 4 shows fire-lighters prepared by an alternative method according to the invention; and FIG. 5 illustrates diagrammatically a further method according to the invention.

Referring first to FIGS. 1 to 3, there is illustrated a method of forming packages of eight fire-lighters, using a continuous process commencing with a single continuous sheet of polythene and a fluid fire-lighter mixture.

The continuous sheet of plastics material 10 passes from a storage reel (not shown) over a V-shaped plate 11. At the apex of the V a blade 12 slits the sheet of plastics material on its centre line and each half of the sheet is wrapped around the plate 11 so that it changes direction through 90°. The two halves 13 and 14 travel away from one another, pass around rollers 15 and 16 respectively, and then travel towards one another again. They pass over rollers 17 and 18 respectively, and then travel downwardly, face-to-face, a slight distance apart.

The rollers 17 and 18 are spaced sufficiently far apart to permit a set of eight injection nozzles 19 to lie between the two separate facing sheets of plastics material. Only one of the tubes 19 is shown in FIG. 3 for the sake of simplicity. Positioned below the roller 17 are nine pairs of heaters, each pair comprising a front heater 20 and a rear heater 21. The pairs are spaced apart across the width of the sheets of plastics material, there being one pair lying on each side of each tube 19. Each rear heater 21 is reciprocable towards and away from its associated heater 20. As shown in FIG. 2, the adjacent faces of the heaters are chamfered at 22 so that they contact the plastics material only over a narrow vertically extending region.

Below the heaters 20 there are six cutting wheels 23 each co-operating with a backing roller 24. The wheels are spaced apart across the width of the plastics sheets in two groups of three, with a slitting knife 24*a* positioned between the two groups. Each cutting wheel 23 is bevelled to give a sharp cutting edge 25 but the cutting edge is interrupted periodically by notches 26. The injection nozzles 19 extend to just below the cutting wheels 23.

Below the cutting wheels 23 is a transversely extending heater comprising a front heater 27 and a rear heater 28. The heaters 27 and 28 are reciprocable towards and away from one another and are also movable between the position shown and a lower position shown in dotted lines in FIG. 1. The heater 27 contains a knife 29 with a serrated edge which is movable into a slot 30 in the facing heater 28.

The object of the heaters 20 and 21 is to form the two sheets of plastics material into a series of parallel tubes, each tube containing one of the injection nozzles 19. In the position shown in the Figures the heaters 21 have just moved towards the heaters 20 to clamp the plastics material together and form a series of vertically extending parallel seals. Below the heaters 20 and 21, the plastics material has already been formed into tubes by earlier movements of the heaters 20 and 21. While the heaters 20 and 21 are making their seal, the heaters 27 and 28 move to their upper position and close to form a transverse seal extending across the width of the plastics material. This transverse seal forms the set of tubes into a set of envelopes open only at their upper ends. The knife 29 also performs a cutting or perforating function as described below.

After the transverse seal has been formed, a fluid fire-lighter mixture is injected into each of the envelopes through the associated nozzle 19. The heaters 27 and 28, which are still gripping the plastics material, are then moved to their lower position, drawing the plastics material downwardly and drawing more of the continous sheet 10 into the apparatus. Before the heaters 27 and 28 move downwardly the upper heaters 21 have moved away from their associated heaters 20 to free the plastics material. When the heaters 27 and 28 reach their lower position, they open and then travel upwardly to their upper position where they close to make a further transverse seal.

The central slitting blade 24 severs the plastics material down the middle of the central seal so that the eight attached tubes become two sets of four attached tubes. At the same time the cutting wheels 23 form vertical cuts in the centre of the seal between adjacent tubes. Because of the notches in the cutting wheels, they do not perform a continuous cut but perform a cut which is interrupted by small bridges 31. In each set of four tubes therefore, the tubes of the set are separated by lines of weakness.

On every first cut, the blade 29 moves sufficiently far into the slot 30 to cut completely through the plastics material. On every second cut, it does not move so far, and only perforates the plastics material in the centre of the transverse seal. Thus in FIGS. 1 and 2 there is shown a lowermost cut edge 32, and a perforated line of weakness 33. The knife 29 is about to make a further complete cut, therefore cutting off sixteen fire-lighters 34. The fire-lighters are arranged in two separate packs of eight, and each fire-lighter comprises a fire-lighter mixture within an air tight combustible skin. Because all the cuts are made through the centre of the seals, part of a seal is left on each side of a cut, and the envelopes containing the fire-lighter mixture are not punctured by the cuts. Each fire-lighter can be separated from the other fire-lighters of the pack by tearing along the lines of weakness and can then be handled and placed in a fire without dirtying the hands or releasing the odour of the fire-lighter mixture.

In order to reduce the risk of the nozzles 19 becoming clogged, a fire-lighter mixture with a very slow setting time is used, of the order of twenty four hours. The packages of fire-lighters which are cut off on every second cut of the knife 29, are removed, e.g. by a conveyor, and are stored until the mixture has set within the sealed envelopes. The fire-lighters are then ready for sale.

The fire-lighter mixture is mixed in a hopper 40, shown in FIG. 3. The ingredients of the mix comprise paraffin, water, emulsifier, urea-formaldehyde resin, and an acid catalyst. The setting of the mix is brought about by the interaction between the resin and the catalyst, and the catalyst is therefore fed into the hopper 40 through a separate pipe 41. The remaining ingredients are fed into the hopper through a pipe 42. The supply of mixture through the pipe 42 is controlled by a float-operated valve within the hopper 40, which maintains the level of mixture in the hopper 40 at a constant level. At the base of the hopper 40 there is a pump 43 which pumps the mixture to an adjustable metering pump 44. At the appropriate point in the cycle, the metering pump 44 pumps an appropriate charge of the mixture to a manifold 45 and thence through eight pipes to the eight nozzles. Only one of the pipes 46 is shown in FIG. 3 for the sake of simplicity. Each time a charge of the mixture is pumped by the metering pump 44, a charge of acid catalyst is squirted into the hopper 40 through the pipe 41.

Turning now to FIG. 4, there are shown four white fire-lighters 50 each sealed within its own air tight skin. The envelopes are formed by placing the fire-lighters in parallel spaced apart relation on a first sheet of polythene or polyethylene film, covering the fire-lighters with a second sheet of film, and shrinking the second film while sealing it to the first film around each fire-lighter, for example by welding. Lines of weakness 51 are provided between adjacent skins and the skins are inflammable. Like the packs formed by the method described with reference to FIGS. 1 to 3, the pack shown in FIG. 4 is simple and compact, and the sealed skins retain the odour of the fire-lighters. In use there is no necessity to handle the fire-lighters themselves or unwrap them. The desired number of fire-lighters is separated from the pack, placed in position, and ignited while the fire-lighters are still within their skins.

Turning now to FIG. 5, there is illustrated a method of forming fire-lighters according to the invention by applying a fluid to the fire-lighters and allowing the fluid to set to provide a combustible coating for the fire-lighter. There is a continuous conveyor 52 from which hangs a plurality of fire-lighters 53. The fire-lighters are formed in moulds, a piece of cord or wire 54 being inserted into each mould before the fire-lighter sets. This cord or wire is subsequently used to attach the firelighter to the conveyor 52. The conveyor moves past a pair of spray nozzles 55 which are positioned to thoroughly spray all faces of each fire-lighter with a molten plastics material which solidfies on cooling to provide an air tight inflammable skin for the fire-lighters. After the coating has been cooled, the fire-lighters are removed from the conveyor by cutting the wire or string 54 and are then packaged.

The invention is not restricted to the details of the foregoing embodiments. For instance in the method illustrated with reference to FIGS. 1 to 3, a fast setting mixture may be utilised if desired, for example a mixture which begins to gell within two or three seconds, and in which setting is complete within twenty to thirty seconds. To prevent the nozzles becoming clogged, two nozzles may be provided within each envelope, one to insert a mixture containing paraffin, water, emulsifier and resin, and the other to insert a mixture containing paraffin, water, emulsifier and catalyst. Other forms of sealing and cutting devices may be used.

Ingredients other than those mentioned may be added to the fire-lighter mixture to improve the appearance or other properties of the fire-lighter. Dyes, pigments or other colouring agents may be added to the mixture and other ingredients may be added to reduce the odour of the fire-lighter mixture or reduce any tendency for paraffin to bleed out of the solidified emulsion. Coated or laminated plastics films may be used to form the skins. The packs of fire-lighters need not contain four or eight fire-lighters as indicated and a pack may for example contain three, five, six, ten, twelve, twenty, twenty four, or any other desired number of fire-lighters. Although methods according to the invention have been described with reference to a paraffin-water emulsion solidified by catalysing urea-formaldehyde resin, the invention is not restricted to this form of fire-lighter mixture. For instance other paraffin or peat based fire-lighter mixtures may be used.

Where the air tight combustible skin is provided by applying a fluid to the fire-lighter, the fluid need not necessarily be applied by spraying. For instance the conveyor 52 shown in FIG. 5 might be arranged to draw the fire-lighters through a dipping tank, or alternatively the fluid could be applied by painting. Instead of comprising a molten plastics material, the fluid could comprise a plastics material dissolved in a solvent, removal of the solvent causing the plastics material to solidify. A further possibility is that the fluid might comprise a mixture of a fluid plastics material and a hardener.

I claim:

1. A method of manufacturing a fire-lighter, comprising the steps of forming a combustible envelope of an air-impervious, flexible material, inserting a combustible material in fluid form into said envelope, said combustible material being settable and including an odoriferous fuel capable of being transferred from the surface of said combustible material during handling, sealing said envelope, and allowing said combustible material to set, whereby the fire-lighter may be handled and placed in position in a fire without dirtying the hands or releasing the odour of the fire-lighter.

2. A method as claimed in claim 1, in which a plurality of envelopes are formed simultaneously by sealing together two layers of combustible plastic material at predetermined locations, said combustible material is then injected into the envelopes simultaneously through a plurality of nozzles, said envelopes are sealed and said combustible material is allowed to set, forming a plurality of fire-lighters.

3. A method as claimed in claim 2, for continuously manufacturing said fire-lighters and in which two continuous layers of combustible heat-sealable plastic material are positioned one on each side of a plurality of parallel spaced apart injection nozzles, the layers are longitudinally heat sealed together at spaced intervals to form a plurality of longitudinally extending tubes, each containing a nozzle, the layers are transversely heat sealed forming a first seal and thereby forming a first set of envelopes, the combustible material is then injected through said injection nozzles into each envelope of the set, the filled envelopes are drawn away from the nozzles, and the layers are again transversely heat sealed at a position spaced from said first seal thereby forming a further transverse seal to seal a first set of envelopes and form the first seal of a second set of envelopes.

4. A method as claimed in claim 3, in which cutting wheels are used to form lines of perforations between adjacent tubes.

5. A method as claimed in claim 3 in which the sealed layers at alternate transverse seals are partially cut through to provide a line of weakness separating a set of sealed envelopes from the next set of sealed envelopes and the sealed layers at the intervening transverse seals are cut completely through to separate sets of sealed envelopes.

* * * * *